United States Patent [19]

Klein

[11] 4,189,180

[45] Feb. 19, 1980

[54] VENTILATED SEAT CUSHION CONSTRUCTION

[76] Inventor: Harold R. Klein, 411 N. Lincoln, Lodi, Calif. 95240

[21] Appl. No.: 968,442

[22] Filed: Dec. 11, 1978

[51] Int. Cl.[2] ..... A47C 7/02

[52] U.S. Cl. ..... 297/453

[58] Field of Search ..... 5/347; 297/453

[56] References Cited

U.S. PATENT DOCUMENTS

| | | | |
|---|---|---|---|
| 2,807,809 | 10/1957 | Kotteman | 297/453 X |
| 2,931,427 | 4/1960 | Goldstein | 297/453 X |
| 3,162,487 | 12/1964 | Trotman | 297/453 |
| 3,162,488 | 12/1964 | Trotman | 297/453 |
| 4,043,544 | 8/1977 | Ismer | 297/453 X |

*Primary Examiner*—James C. Mitchell

*Attorney, Agent, or Firm*—Lothrop & West

[57] ABSTRACT

A ventilated seat cushion, especially for use on automobile seats, has a pair of cushions connected by a flexible hinge. In each cushion, a grid-like framework of upstanding support ribs includes a pad situated at the bottom of each of the rib intersections, and apertures are formed in the upper edge of each rib between rib intersections to afford fore and aft and transverse channels for the free circulation of air. A stiffening marginal band is attached to the periphery of the grid-like framework and a foraminous fabric cushion cover overlies the grid framework and marginal band. Conventional binding secures the cushion cover to the marginal band. Ventilation is provided by air movement not only in fore and aft and transverse directions through the apertured portions of the grid framework but also into and out of the cushion through the mesh-like fabric cover.

4 Claims, 7 Drawing Figures

VENTILATED SEAT CUSHION CONSTRUCTION

BACKGROUND OF THE INVENTION

The invention relates to improvements in ventilated seat cushions, such as those commonly used in automobiles, boats, aircraft, and the like.

Heretofore, a very widespread type of cushion construction employed coiled wire enclosed by a casing or cover of fabric. However, coil spring cushions exhibit numerous shortcomings, such as eventual rusting of the metallic coil springs, damage to the flexible covers caused by the abrasive action of the coil springs, discomfort to the user owing to sharp ends of the wires protruding through the covers, inability of overstressed cushions adequately to support the user, with consequent loss of proper ventilation, and relatively high cost.

Improvements in the design of seat cushions were forthcoming, and the most promising proposals supplanted the metal coils with a support system based on "plastic" constructions of various kinds.

For example, Trotman U.S. Pat. No. 3,162,487, uses a thin, flexible, plastic sheet including a plurality of vacuum-formed hollow projections upon which the seat cover is supported. In contrast, the present invention includes a support system comprising a plastic grid-like framework having fore and aft and transverse stiffening ribs with discs, or pads, located at the bottom of the rib intersections. While Trotman relies on circular openings interspersed between the projections in the plastic sheet to enhance ventilation, the present invention enjoys virtually all of the open space defined by the grid pattern for ventilation, excepting the relatively small area covered by the discs, the lower edges of the ribs of the grid framework and the marginal band. Thus, the present invention represents a significant improvement over Trotman owing to the substantial increase ventilation afforded by the present invention.

Another example, Goldstein U.S. Pat. No. 2,931,427, illustrates the use of a grid-like support framework overlaid by a perforated seat cover. While the grid-like framework disclosed therein somewhat resembles that of the present invention, several important distinguishing features exist. The ventilating apertures in Goldstein, for example, are found only in the fore and aft rows of ribs, and even then, only in the lower portion of those ribs. In the present construction both transverse and fore and aft ventilation channels are provided and the air flow channels are located on the upper or outer edges of the ribs for optimum cooling effect owing to the proximity to the user's body.

SUMMARY OF THE INVENTION

The invention relates generally to seat cushions, and, more particularly, to seat cushions which are devoid of protuberances caused by steel springs, coils, and the like, yet which are durable and economical, and which are especially comfortable in hot weather in that they enhance the flow of cooling air adjacent the user's body.

A square gridwork of ribs intersecting at right angles includes pads supporting each intersection. Between the intersections the upper, or outer, edges of the ribs are cut away to provide air flow channels in both a fore and aft and a transverse direction. The individual chambers defined by the ribs are thus in free communication, each with the others. A foraminous, meshlike fabric covers the upper side of the cushion so that air can flow in and out of the cushion as well as freely circulate within the cushion to help cool the user's body in proximity therewith.

DETAILED DESCRIPTION OF PREFERRED EMBODIMENT OF THE INVENTION

Figure 1:
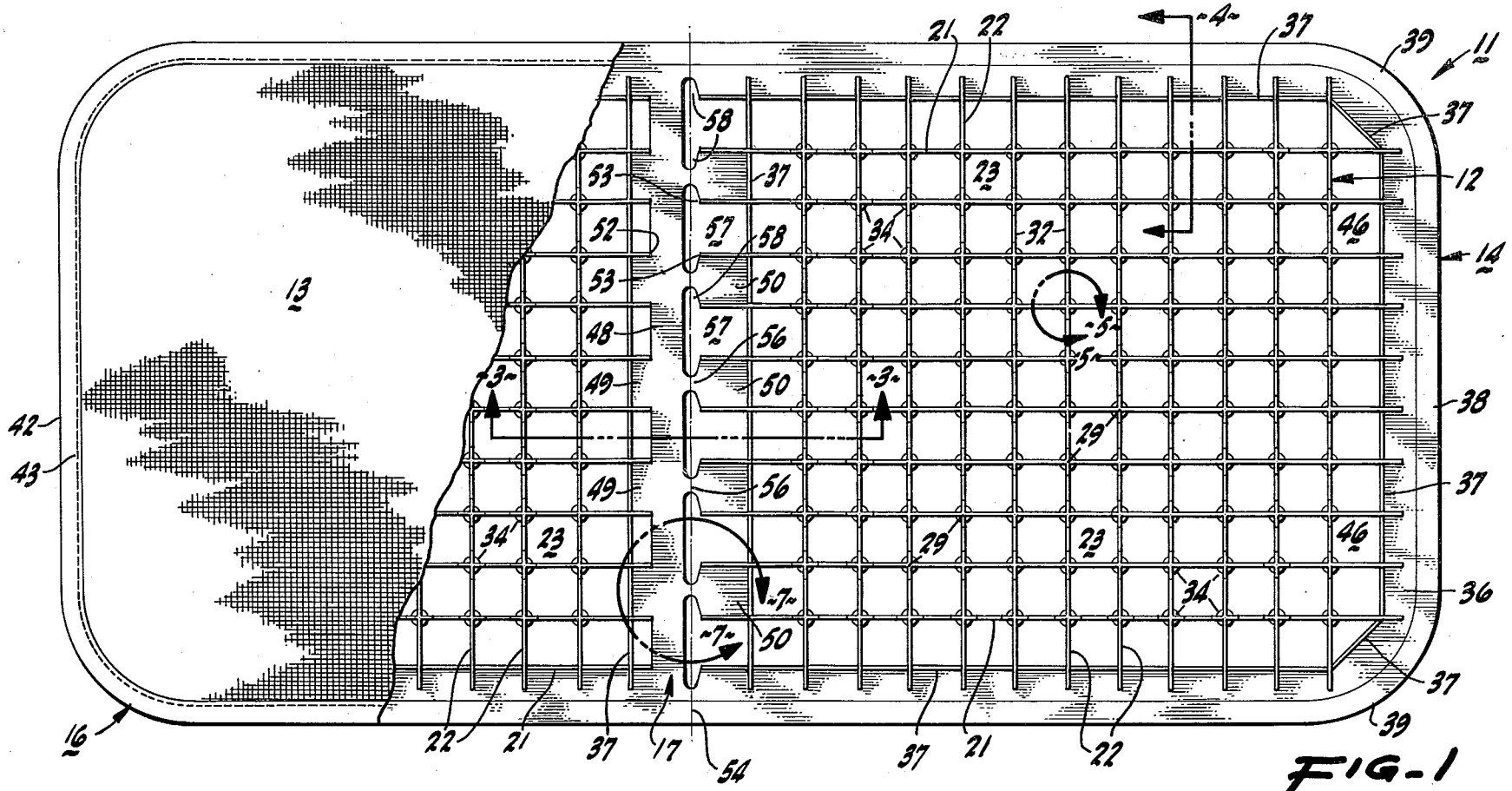
FIG. 1 is a top plan view of a ventilated cushion constructed pursuant to the invention, the cushion being shown in fully extended position, with a portion of the foraminous fabric cover broken away to reveal the underlying grid-like framework of ribs and pads.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology, or terminology employed herein is for the purpose of description and not limitation.

The ventilated seat cushion construction of the invention, generally designated by reference numeral 11, broadly includes a grid-like framework 12 and a foraminous, mesh-like fabric cover 13. In most cushions the cushion is in two portions, a back portion 14 and a seat portion 16, the back and seat portions being connected by a flexible transverse hinge portion 17.

Preferably, the back portion 14 of the cushion is somewhat longer than the seat portion 16, but in all other respects, except for the hinge structure 17, the two portions are substantially identical. Consequently, a description of one will serve equally to describe the other.

The combined length of the two cushion portions 14 and 15 somewhat exceeds the width of the cushion. Thus, the over-all cushion is somewhat elongated and the upstanding support ribs running parallel to the elongated dimension of the cushion are termed fore and aft ribs 21, or longitudinal ribs, whereas the upstanding support ribs running parallel to the width dimension are designated as transverse ribs 22.

As appears most clearly in FIG. 1, the fore and aft ribs 21 and the transverse ribs 22 intersect at right angles and are so spaced as to form the grid-like framework 12 in which the ribs define a plurality of square openings 23 which are relatively large in size to enhance the free circulation of air.

Each of the ribs 21 and 22 is defined by a linear lower edge 24 and an upper edge 26 which varies in profile in a manner to be explained below in detail.

Figure 3:
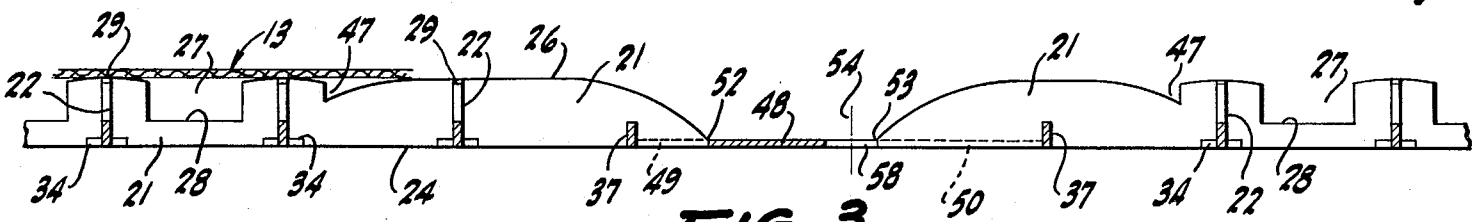
FIG. 3 is a fragmentary, longitudinal, sectional view, to an enlarged scale, the plane of the section being indicated by the line 3—3 in FIG. 1.
Figure 2:
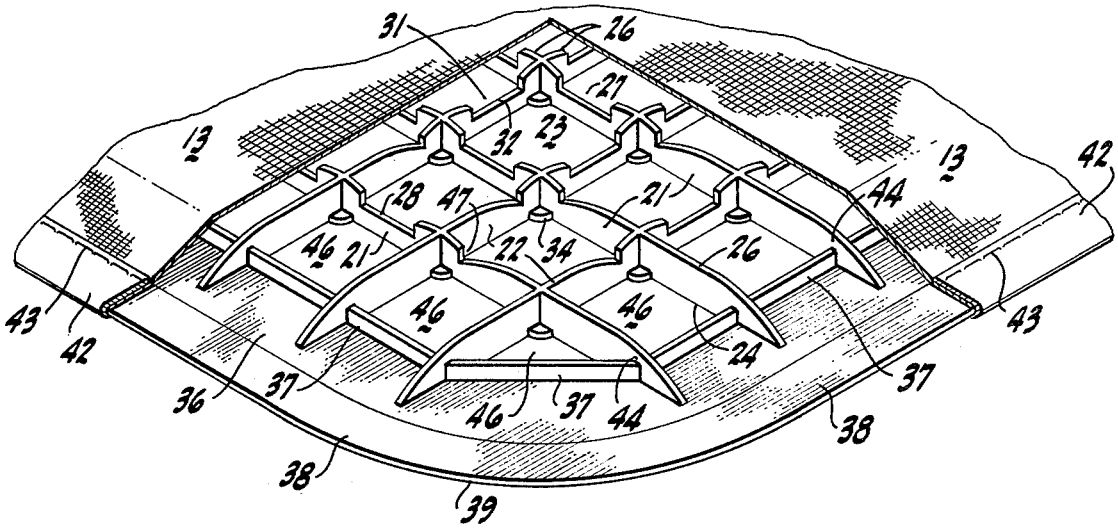
FIG. 2 is a fragmentary, isometric view, to an enlarged scale, of the lower right-hand corner of the cushion shown in FIG. 1.

The free movement of cooling air in a transverse direction is provided by transverse channels 27 defined by weir-shaped recesses 28 formed in the upper edges 26 of the fore and aft ribs 21 intermediate the intersections 29 of the fore and aft ribs 21 and the transverse ribs 22, as is clearly shown in FIGS. 2 and 3.

Figure 4:
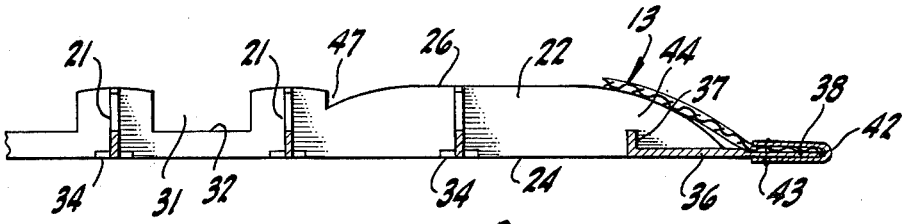
FIG. 4 is a fragmentary, transverse, sectional view, to an enlarged scale, the plane of the section being indicated by the line 4—4 in FIG. 1.
Figure 5:
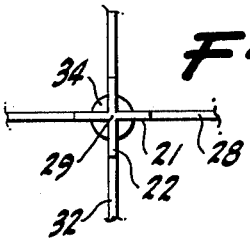
FIG. 5 is a fragmentary top plan view, to an enlarged scale, of a rib intersection.
Figure 6:
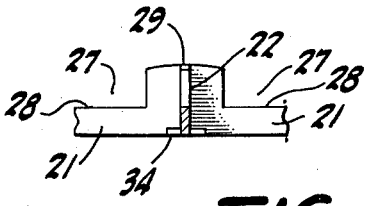
FIG. 6 is a fragmentary side elevational view of the rib intersection of FIG. 5 taken at right angles to the fore and aft rib; and, FIG. 7 is a fragmentary top plan view, to an enlarged scale, of the hinge in the vicinity of the hinge axis, as indicated by the arcuate arrow in FIG. 1.

In like manner, the free movement of cooling air in a fore and aft direction is enhanced by a plurality of fore and aft channels 31 formed by weir-shaped indentations 32 in the upper edges 26 of the transverse ribs 22, as appears most clearly in FIGS. 2 and 4.

The weir-shaped structure of both the transverse channels 27 and the fore and aft channels 31, promotes increased air dispersion and consequently more effective cooling. As air passes through the channels, the portion of the wall of each rib below the indentations 28 and 32 acts in the nature of a partial barrier and urges the air to billow upwardly. Vertical mixing of the cooling air is thus enhanced by the partially obstructed passage of air through the entire grid-like framework 12.

Although the total surface area of the lower edges 24 of the fore and aft ribs 21 and the transverse ribs 22 is quite adequate to provide support for the cushion at the interface with the underlying seat and back of seat, the unit support pressure, or weight per unit of area, is advantageously reduced even more owing to the provision of support pads 34, or discs, situated concentrically at the bottom of each of the rib intersections 29.

The pads 34 are preferably circular in plan and the bottoms of the pads are substantially flush with the plane of the bottom edges 24 of the ribs 21 and 22. The pads do not interfere with the free circulation of cooling air to any significant extent, yet they not only reduce the unit pressure against the seat and seat back surface but they also provide a desirable measure of strength and rigidity to the grid network 12.

Additional strength and an esthetically pleasing "rounding off" of the cushion 11 is afforded by a peripheral band 36, or strip, of relatively thin plastic material, as illustrated most clearly in FIGS. 1, 2 and 4.

The peripheral band 36 originates along a series of low peripheral walls 37 extending between the outer portions of the ribs 21 and 22 and projects away from the wall in a plane substantially coplanar with the plane of the bottom edges 24 of the ribs, terminating in a margin 38 having smoothly rounded corners 39.

Adjacent their extremities, that is to say, in the vicinity of the low peripheral walls 37, the ribs 21 and 22 taper down to and merge with the peripheral band 36, as best shown in FIG. 2. Such construction affords a smooth transition along the marginal edges of a foraminous fabric top cover 13 secured to the band margin 38 by conventional binding 42 and stitching 43.

The fabric cover 13 is supported on the upper edges 26 of the ribs 21 and 22 and is of open, mesh-like construction through which cooling air can freely pass. Thus, in conjunction with the expansive grid openings 23, longitudinal channels 31 and cross channels 27, the loose weave of the cover 13 provides an eminently satisfactory flow of cooling air, both into and out of the gridwork and within the gridwork itself. Furthermore, the air flow is channeled in close proximity to the user's body so that optimum cooling is achieved.

As will especially be seen in FIG. 2, the top of the low peripheral wall 37 is below the upper tapered edges of the ribs 21 and 22 where the ribs merge downwardly into the peripheral band 36, thus providing a relatively uninhibited passageway 44 for the movement of air into and out of the outermost or marginal apertures 46. Where appropriate, auxiliary indentations 47 are formed in the ribs 21 and 22 to assure the continuity of air flow in all directions. Again, the auxiliary passageways defined by the indentations are located on the top edges of the ribs for optimum ventilation.

For greatest comfort to the user, the seat portion 16 and the back portion 14 of the cushion 11 each possesses its own grid-like framework, marginal band and porous fabric cover, the two portions 16 and 14 being joined by the flexible hinge structure 17 comprising a transverse band 48 of the same relatively thin plastic material (for example, molded high flow, low density polyethylene) as the marginal band 36. Preferably, the transverse hinge band 48 is connected to and is continuous with the marginal band 36.

As indicated most clearly by surface shading in FIG. 1, the transverse band 48 extends into alternative longitudinal rows in both the seat portion 16 and the back portion 14 of the cushion 11, the respective longitudinal extensions being indicated by the reference numerals 49 and 50.

The hinge band extensions 49 and 50 terminate at the contiguous low peripheral walls 37. In the longitudinal rows into which the hinge band extensions 49 and 50 do not project, the main hinge band 48 terminates at a location coterminous with the respective ends 52 and 53 (see FIG. 3) of the longitudinal ribs 21.

Figure 7:
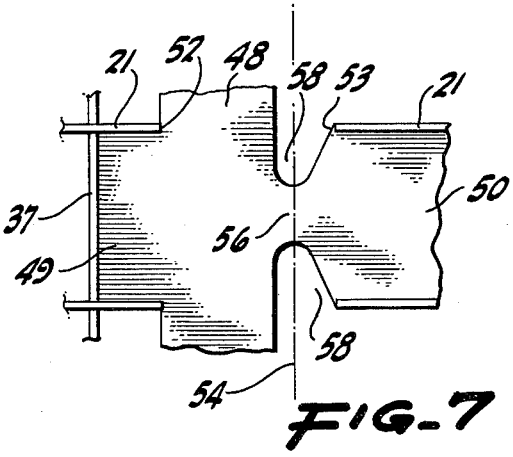

The bending axis 54, or centerline, of the cushion hinge 17 is created by reducing the transverse dimension of the hinge band 48 so as to reach a maximum reduction on a line co-linear with the axis 54. Thus, as appears most clearly in FIGS. 1, 3 and 7, the hinge band 48 is formed with a plurality of necks 56, each neck having its narrowest dimension on the axis 54. The neck 56 is defined by extending longitudinally and transversely enlarging the alternating apertures 57 in the back portion 14 into the area of the hinge band 48, the transversely enlarged portions of the apertures 57 being indicated by the reference numeral 58 in FIG. 7.

When the cushion 11 is to be stored, it can readily be folded along the hinge line 54 so that the seat portion 16 is against the back portion. To use the cushion, the back and seat portions are unfolded along the hinge line 54 and placed against the respective seat back and seat.

It can therefore be seen that I have provided a light, economical seat cushion which is not only durable and esthetically pleasing, but which also enhances the free movement of cooling air in the vicinity of the user's body.

I claim:

1. Ventilated seat cushion construction comprising:

a. a grid frame including a plurality of fore and aft rows of upstanding ribs and a plurality of transverse rows of upstanding ribs, said fore and aft ribs being oriented at right angles to said transverse ribs and being joined to said transverse ribs at the intersections therewith;

b. cushion support means including a plurality of discs or pads, said discs being centered on said intersections, affixed to the lower edges of said ribs with the bottoms of said discs substantially flush with the plane of said lower edges of said ribs, and located in a plane perpendicular to said ribs; and, c. ventilation means including a plurality of extended weir-shaped indentations in the upper edges of said ribs, said indentations being located between said intersections and defining a plurality of channels for the passage of air both in a transverse and in a fore and aft direction.

2. A ventilated seat cushion construction as in claim 1 further comprising:

a. a substantially rigid marginal band affixed to the outer periphery of said grid frame;

b. a foraminous cushion cover in face to face contact with the upper side of said grid frame and said marginal band; and, c. means for binding said cushion cover to said marginal band.

3. A ventilated seat cushion construction as in claim 2 in which said cushion comprises two ventilated seat cushion portions hingedly connected by a flexible hinge, said hinge including a plurality of fore and aft straps hingeably linking two seat cushion portions.

4. A ventilated seat cushion construction as in claim 3 in which each of said plurality of straps is formed with a reduced width neck along a transverse axis to increase the pliability of said flexible hinge along said axis.

* * * * *